US006475315B1

(12) United States Patent
Kean et al.

(10) Patent No.: US 6,475,315 B1
(45) Date of Patent: Nov. 5, 2002

(54) METHOD FOR MAKING NONWOVEN FIBROUS PRODUCT

(75) Inventors: James Harvey Kean, Boulder, CO (US); Tod Mitchell Kean, Chandler, AZ (US); Kenneth Roger Williams, Landenberg, PA (US)

(73) Assignee: Boricel Corporation, Chandler, AZ (US)

( * ) Notice: Subject to any disclaimer, the term of this patent is extended or adjusted under 35 U.S.C. 154(b) by 0 days.

(21) Appl. No.: 09/850,710

(22) Filed: May 8, 2001

Related U.S. Application Data

(60) Division of application No. 09/366,487, filed on Aug. 3, 1999, now Pat. No. 6,305,920, which is a continuation-in-part of application No. 09/144,919, filed on Sep. 1, 1998, now Pat. No. 6,159,882.

(60) Provisional application No. 60/058,935, filed on Sep. 9, 1997.

(51) Int. Cl.[7] ..... D04H 1/54; D04H 1/70; D04H 3/14

(52) U.S. Cl. ..... 156/62.2; 156/296; 264/122; 19/296; 19/305

(58) Field of Search ..... 156/62.2, 296; 264/126, 122; 19/105, 304, 305, 296

(56) References Cited

U.S. PATENT DOCUMENTS

| | | | | |
|---|---|---|---|---|
| 2,940,133 A | | 6/1960 | Heritage | |
| 2,953,187 A | | 9/1960 | Francis | |
| 3,616,160 A | | 10/1971 | Wincklhofer et al. | |
| 3,736,211 A | | 5/1973 | Lipscomb et al. | |
| 4,634,739 A | | 1/1987 | Vassilatos | |
| 4,640,810 A | | 2/1987 | Laursen et al. | |
| 4,734,957 A | * | 4/1988 | Lenzen | 19/105 |
| 5,023,131 A | * | 6/1991 | Kwok | 156/296 |
| 5,229,052 A | | 7/1993 | Billiu | |

* cited by examiner

*Primary Examiner*—Sam Chuan Yao
(74) *Attorney, Agent, or Firm*—Huntley & Associates

(57) ABSTRACT

Process for making nonwoven fibrous webs having substantial strength in the direction normal to their planes. The webs exhibit good acoustical insulation properties.

16 Claims, 1 Drawing Sheet

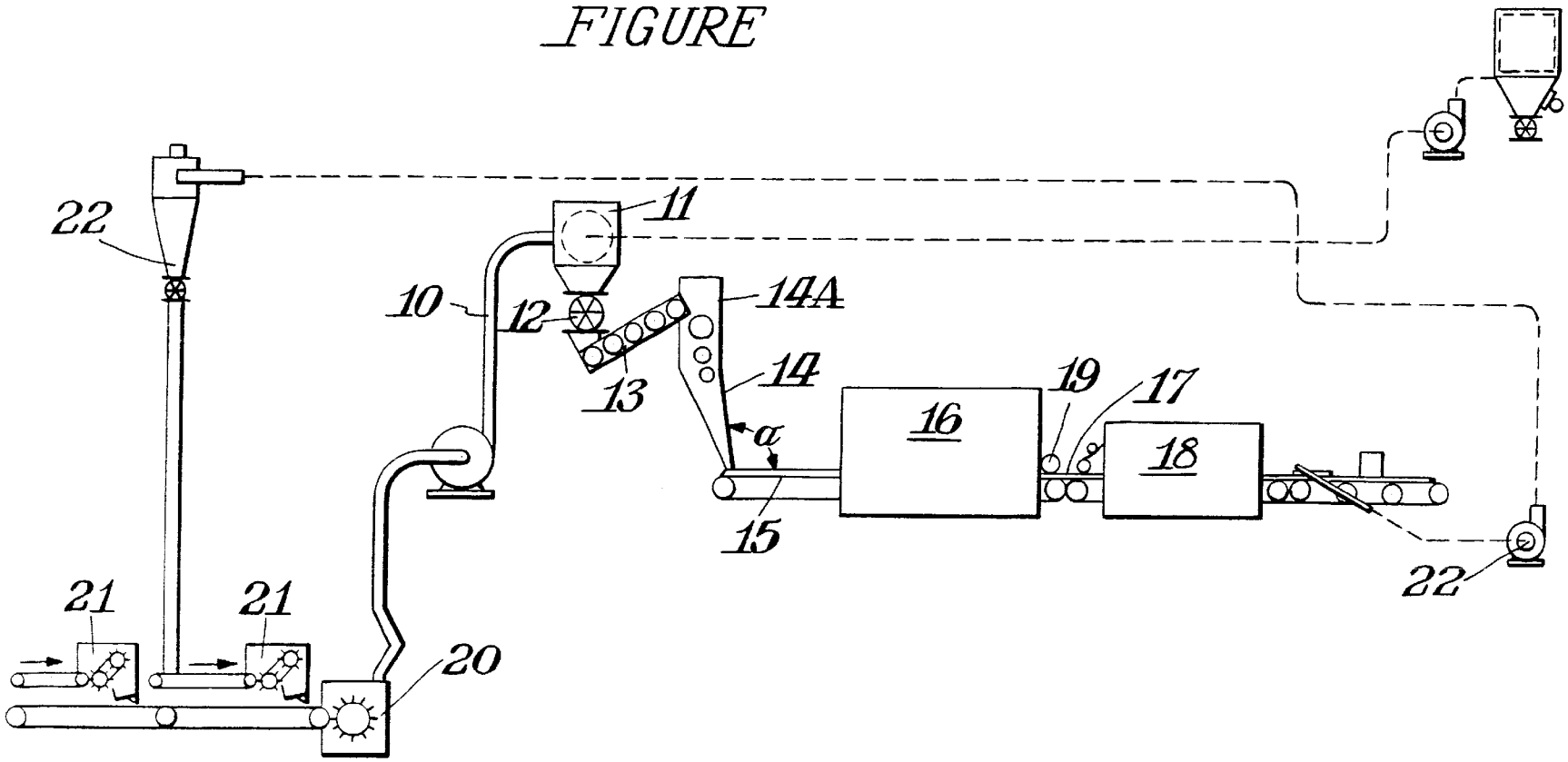
FIGURE

METHOD FOR MAKING NONWOVEN FIBROUS PRODUCT

CROSS-REFERENCE TO RELATED APPLICATION

This application is a division of co-pending application Ser. No. 09/366,487 filed Aug. 3, 1999 now U.S. Pat. No. 6,305,920 B1, which is a Continuation-in-Part of application Ser. No. 09/144,919 filed Sep. 1, 1998 now issued as U.S. Pat. No. 6,159,882, which is based on Provisional application No. 60/058,935 filed Sep. 9, 1997.

BACKGROUND OF THE INVENTION

Nonwoven structures have long been known and used, for example, in papermaking and felting operations. More recently, alternative techniques have been used to form coherent webs of fibrous materials. For example, nonwoven structures can be made using cotton processing technology, including the use of cards and garnets. Carded webs tend to be light weight. To make thicker webs, multiple cards, transverse folding of the web or "crosslapping" can be used. Garnets can also be used to make a thick web from one or more fibers and/or fabric waste.

Airlaid webs represent still another approach to making nonwoven products. There, a heavy pulp sheet is defibered in a hammermill or pin mill into individual pulp fibers in an air stream. The air borne dispersed fibers are condensed, via vacuum, onto a porous belt, forming a planar web. The fibers are deposited, in a horizontal orientation, on the porous belt. Multiple layers can be built up, but there is little strength between layers.

The various products made using these techniques, because of their limited strength, are often further treated by a variety of bonding techniques. Mechanical bonding techniques have included needle punching, stitch bonding, and hydroentangling. Chemical bonding techniques generally involve a latex application. In thermal bonding techniques, a fusible substance, generally a powder or fiber, is used to form a support of unbonded fibers into a connected network.

While certain of the mechanical processing techniques described above, such as needle felting, stitchbonding and hydroentangling, can provide some strength in the thickness direction, they do not function on an individual fiber basis, and crosslapped structures, or even those which have been treated with latex bonding or using binder fiber, still have little strength in the thickness direction, that is, the direction normal or perpendicular to the major plane of the web. Such products accordingly have limited utility in multiple use applications.

SUMMARY OF THE INVENTION

The present invention provides a process for producing nonwoven products that have significant strength in the direction normal or perpendicular to their planes, but without the time consuming steps of previously used techniques such as needle punching, stitch bonding and the like.

Specifically, the instant invention provides a process for forming a web of fibrous material comprising:

(a) admixing about from 50 to 95% by weight of at least one support fiber for a period sufficient to disentangle and open the fibers and simultaneously or subsequently admixing therewith about from 5 to 50% by weight of at least one binder fiber to provide a substantially homogeneous mixture of fibers;

(b) conveying the mixture of fibers into a shaker chute positioned at an angle of about from 90 to 150 degrees with respect to horizontal;

(c) oscillating the fibers in the shaker chute for a period of about from 5 seconds to 1 minute;

(d) depositing the fiber web onto a substantially horizontal planar surface at a substantially uniform thickness of about from ⅛ to 6 inches;

(e) heating the fibers for a time and at a temperature sufficient to fuse at least some of the fibers; and (f) cooling the resulting web to a substantially ambient temperature.

The present invention also provides an apparatus for making the fibrous webs and the resulting bonded webs having machine direction and transverse direction axes forming a major plane, and a substantially homogeneous upper surface and comprising fused fibers, in which the Tensile Strength of the web in the direction normal to the major plane is about from 25% to 120% of the Tensile Strength in the machine direction in the major plane of the web.

BRIEF DESCRIPTION OF THE DRAWING

The FIGURE is a flow diagram of an apparatus that can be used in the present invention.

DETAILED DESCRIPTION OF THE INVENTION

The present invention is based on the discovery of a process and apparatus that results in a bonded fibrous web having a substantial percentage of the fibers in the web oriented in a direction normal or perpendicular to the major plane of the web, resulting in a Tensile Strength in this direction that is substantially higher than would be expected in a bonded web that has not been subjected to mechanical or hydraulic intertangling. In the present invention, the direction normal or perpendicular to the major plane of the web is designated the "Z" direction.

The webs of fibrous materials of the present invention comprise about from 50 to 95%, and preferably about from 65 to 95%, of a support fiber which can be prepared from a variety of fibers, including recycled, synthetic and natural fibers. The length of the fibers used to make the webs will, to some extent, vary with the intended use of the final product. However, in general, the fibers should have a length of about from ⅛ to 4 inches. The fibers can be cut to the desired length by any known technique.

While a wide variety of fibers can be used for the support fibers, the support fiber may be 100% natural fiber or 100% synthetic fiber. It has been found to be particularly advantageous to use a mixture of natural and synthetic fibers. Of the natural fibers, cotton is preferred for many applications due to its ready availability. The many synthetic fibers which can be used include polymeric fibers and mineral fibers. Of the many polymeric fibers available, nylon, polyester, acrylic and polyolefin fibers with a fusion temperature of at least 60° C. above the fusion temperature of the binder fiber have been found to be particularly satisfactory. Of the polyolefin fibers, polyethylene and polypropylene are preferred. Representative mineral fibers which can be used include steel slag and glass fibers. When the support fiber is a mix of natural and synthetic fibers is used, the blend will preferably comprise, by weight based on the total support fiber blend, about from 10 to 90% of the natural fiber and about from 10 to 90% of the synthetic fiber.

The support fiber can also comprise secondary cellulose fiber. When used, the secondary cellulose fiber can make up part or all of the blend other than the binder fiber. The term "secondary cellulose fiber" as used herein refers to a defibered product obtained by a dry shredding process of newsprint or cardboard, or other similar ground wood products. The secondary cellulose fiber should have a density of up to about 1.5 lb./cubic foot. Densities, as noted herein, will be understood to refer to blown density, as recognized in the art.

The desired density of the secondary cellulose fiber can be conveniently attained through the use of a processing apparatus that results in a relatively long fiber with low concentrations of dust. If desired, the secondary cellulose fiber can be treated with fire retardant, and, in that case, the fire retardant is included in the calculation of the density of the secondary cellulose fiber. To reduce the density of the secondary cellulose fiber, application of the fire retardant in liquid form is preferred. In general, about from 10 to 20% by weight of liquid fire retardant, based on the weight of the secondary cellulose fiber, has been found to be satisfactory for the present products.

The web of fibrous material of the present invention comprises about from 5% to 50% by weight of at least one binder fiber, and preferably about from 10% to 35%. Binder fiber is preferably added to the supply stream separately, through a feeder, and additional blending equipment is used to reduce fiber clumps. Binder fiber, as used herein, includes a wide variety of thermoplastic fibers having a melting point below the decomposition temperature of the other fiber components. Satisfactory fused webs are generally not attained with less than about 5% binder fiber by weight of the total fiber. Concentrations of binder fiber of about from 10 to 35 weight percent are preferred, and a concentration of about 15 percent has been found to be particularly satisfactory.

A wide variety of binder fibers can be used, such as a sheath-core bicomponent fiber, side-by-side bicomponent fiber, polyethylene homofiber, polyethylene pulp and the like. Sheath-core bicomponent fibers are preferred, and especially those comprising at least one of:

(a) an activated copolyolefin sheath and a polyester core;

(b) a copolyester sheath and a polyester core; and (c) a crimped fiber with a copolyester sheath and a polyester core. Of these fibers, those having an activated copolyolefin sheath and a polyester core are particularly preferred.

The processing of the fiber components will be described in conjunction with the FIGURE, which is a flow diagram of an apparatus of the present invention.

In accordance with the present invention, the support fiber and the binder fiber are admixed for a period sufficient to disentangle and open the fibers and provide a substantially homogeneous mixture of the fibers. Opening is used in its usual meaning in the art, specifically, that the fibers be in their original, untangled, configuration. While a wide variety of apparatus can be used for this admixing, it may be convenient to simultaneously admix the components and transport them in duct 10 with turbulent air flow of at least about 1800 fpm. The fibers next preferably go through an air/fiber separator 11 to separate the conveying air from the fibers. After passing through an optional air lock 12, the fibers are then conducted through the remainder of the process by mechanical means and gravity. The fibers are also preferably treated in a step cleaner or other type of mechanical blender 13 which rebulks the fiber web to overcome any compression.

Preferably, the fibers are supplied to blender 20 in controlled amounts from weigh pans 21. Also, an edge trim recycle loop 22 may be used advantageously to reduce waste trimming.

After admixing, the mixture of fibers is conveyed into a shaker chute 14. Of the many standard shaker chutes available, that marketed by J. D. Hollingsworth has been found to be particularly satisfactory. The shaker chute is positioned at an angle of about from 90 to 150 degrees with respect to horizontal, as illustrated in the FIGURE and identified as angle "a," and preferably about from 95 to 135 degrees. An angle of about 120 degrees has been found to be particularly satisfactory. In general, increased angles of the shaker chute will result in lower percentages of the fibers oriented in the "Z" direction, and result in a lower Tensile Strength in that direction.

Preferably, prior to entry into the shaker chute, the fibers are introduced into a substantially vertical web former 14A. By substantially vertical is meant that the web forming chamber is positioned on an angle within 25 degrees of perpendicular, that is, about from 65 to 115 degrees with respect to the horizontal direction.

In the web former and shaker chute, the descending collection of fibers contacts the inclined rear wall of the shaker chute, which oscillates at 50–300 cpm while air jets, typically at least two, in the upper, outer wall cause the fiber web to be laterally uniform as it progresses to the shaker chute exit. In a three dimensional coordinate system, if the direction of fiber flow downward through the shaker chute is considered the Z direction, then most of the fibers are oriented mostly in the X-Y plane. Typically, the fibers are oscillated in the shaker chute for a period of at least about 5 seconds to form a continuous and consistent fiber structure.

The collection of fibers, or fiber stream, leaves the shaker chute onto a horizontal planar surface 15 oriented substantially normal to the shaker chute Z direction. In this way, the fibers in the X-Y plane are rotated through an angle that approaches 90 degrees as they contact the planar surface, or conveyor belt. This X-Y plane of fiber in the shaker chute is now approximately normal to the direction of travel of the conveyor belt. The fibers retain this orientation in the final bonded product. Thus, there is a significant percentage, generally at least about 60%, of fibers oriented along axes that are at substantially right angles to the machine direction of the final product. This 60% refers to the vector sum of all the fiber components in the X-Y plane. The relative X, Y and Z direction strengths of nonwovens made by the process described here will be dependent upon several factors, including (1) the angle made by the shaker chute and the horizontal collection belt, (2) the degree of X direction stretching and nonwoven batt compression that occurs on the collection belt, (3) the quantity and morphology of the binder fiber used. That is, the modulus and extensibility in the cross direction and in the thickness direction will be of the same order of magnitude. However, the machine direction modulus can be influenced by the degree of stretch experienced by the web as it contacts the moving belt and any compression that occurs during bonding and cooling. By adjusting these variables, the fiber orientation in the X-Y plane can be varied substantially above or below 60%.

The resulting fiber stream is deposited onto the substantially horizontal planar surface 15 at a substantially uniform thickness of about from ⅛ to 6 inches. In this manner, at least about 20% of the fibers (the vector sum of the fiber components) are oriented along the Z axis of the resulting web of unfused fibers. This unfused web is then heated in an oven 16 for a time and at a temperature sufficient to fuse the web 17. The time and temperature will be adjusted according to the thickness of the web, the type and concentration of the binder fiber used, and the speed of the apparatus, as will be evident to those skilled in the art.

In the oven, heated air passes through the web. The specific temperature of the heated air will be adjusted, as recognized by those skilled in the art, in accordance with the specific binder fiber used and the thickness of the web being prepared. In general, temperatures of about from 250 to 450 degrees Fahrenheit are used, with residence times in the binder of about from 0.3 to 4.0 minutes.

The resulting web is then cooled to a substantially ambient temperature in cooling unit 18. There, porous belts are preferably provided on both sides of the product to stabilize the construction in the compressed state. The final product can then be cut, stacked, rolled and packaged.

For certain end use applications, the web is preferably compressed by rolls 19 to less than about 80% of its fused thickness, for product uniformity and control of the final density. The compression is preferably carried out simultaneously with cooling of the fused web. Compression is particularly desirable if a higher density nonwoven product is being made, such as one intended for use as a carpet underlayment.

The fibers used for preparation of the webs of the present invention are typically supplied in bales or packages and they enter the process stream from computer controlled weigh pans. An important element of the present process is to have a uniform rate of material flow through all process steps. This can be accomplished by commercially available computer controlled weigh pans and feeding equipment.

The resulting product is particularly unusual for a thermally bonded web, in that the Tensile Strength of the web in the direction normal to the major plane (the "Z" direction) is about from 25% to 120% of the Tensile Strength in the machine direction in the major plane of the web. Preferably, the Tensile Strength in the "Z" direction is at least about 70%, and especially at least about 80%, of the Tensile Strength in the machine direction of the web. Other preferred embodiments include a web wherein the Tensile Strength in the "Z" direction is about 120% of the Tensile Strength in the machine direction. The variables in the present invention can be adjusted so that the Tensile Strength of the finished web in the Z direction can be less than, equal to, or greater than the Tensile Strength in the machine direction. Because the web is not needle punched or stitch bonded, the product has a substantially homogeneous upper surface, that is, it does not vary significantly in its density or surface regularity. The nonwoven fibrous webs of this invention are useful for a wide variety of applications such as thermal insulation, carpet underlayment, ceiling tile, furniture cushioning, and casket pads. Sound absorption measurements made on sheet structures made from the present invention show Noise Reduction Coefficients (NRC) in the same range as fiber glass acoustic boards. Accordingly the products of the present invention can be used for many sound reduction applications, such as acoustical panels.

EXAMPLES 1–4 AND COMPARATIVE EXAMPLES A–C

In Example 1–4, bonded, non-woven products were tested for tensile strength, measured in the X, Y and Z directions of thermally bonded nonwovens made according to the instant invention. In the preparation of the products of Examples 1 and 2, waste textile fibers were admixed with binder fiber. In Examples 1 and 2, blue cotton denim was used as the fiber. In Examples 3 and 4, a white 15 denier polyester fiber was used, blended with 33% and 27% by weight binder fiber in Examples 3 and 4, respectively. The binder fibers were oscillated in the shaker chute for 5 seconds in Examples 1 and 2, and 10 seconds in Examples 3 and 4. In each Example, the shaker chute was positioned at an angle of 120 degrees with respect to the horizontal. These periods of oscillation were sufficient to disentangle and open the fibers and provide a substantially homogeneous mixture of fibers. The fiber web was then deposited at a substantially uniform thickness onto a substantially horizontal planar surface. The web was then heated at a temperature of 350 degrees F. for a period of 90 seconds to fuse at least some of the fibers. The resulting fused web was then cooled to a substantially ambient temperature.

Standard tensile testing procedures, in which the specimens are mechanically clamped in the tester, could not be used to measure properties in the thickness direction. The gauge length was too short. To make the measurements, the nonwovens were cut into blocks that were then bonded to 2"×3" aluminum plates. Perpendicular rods centrally mounted on the plates were placed in the tester clamps. The strength of each sample was measured in its X, Y and Z directions. The key parameter was the Z/X strength ratio.

Each plate was coated with PC-7 Paste epoxy. (Protective Coatings Corp., Allentown, Pa.) A model 1125 Instron Tester was used with a 50 Kg full scale load at a crosshead speed of 20 cm/min. at room conditions of 70° F. and 65% RH. The results are summarized in the Table.

In Comparative Examples A–C, similar measurements were made on a group of commercial thermally bonded nonwovens made with conventional carded web technology.

The bonded nonwoven products of Examples 1–4 show relative strengths in the Z direction that approach and even exceed those in the X (machine) direction. When tested by the procedure used here, the products of Comparative Examples A–C show low Z direction tensile strengths, in the range of 1 to 3%. This is believed to be a result of the fact that very few fibers are oriented in the Z direction in the webs of the Comparative Examples.

TABLE 1

BONDED PAD DIRECTIONAL STRENGTH

| Example | Binder Fiber % Support Fiber %, Type | Test Dir* | Tensile Strength, Kg. | Relative Str Z/X |
|---|---|---|---|---|
| 1 | 23%/77%, Blue denim waste | X | 4.40 | 0.45 |
| | | Z | 2.00 | |
| 2 | 18%/82%, Blue denim waste | X | 2.65 | 1.03 |
| | | Y | 10.00 | |
| | | Z | 2.72 | |
| A | Greenwood Mills product | X | 13.75 | 0.03 |
| | | Y | 10.00 | |
| | | Z | 0.47 | |
| 3 | 33%/67%, 15 den, 1/2" PET | X | 5.14 | 0.82 |
| | | Y | 7.30 | |
| | | Z | 4.20 | |
| B | UB 4015 | X | 50.10 | 0.03 |
| | | Y | 22.50 | |
| | | Z | 1.45 | |
| 4 | 27%/73%, 15 den, 1/2" PET | X | 5.00 | 0.61 |
| | | Z | 3.05 | |
| C | Cushion wrap | X | 40.50 | 0.01 |
| | | Z | 0.58 | |

*Directions: X = Machine Dir., Y = Cross Dir, Z = Thickness

EXAMPLES 5–11 AND COMPARATIVE EXAMPLES D & E

Sound absorption tests were carried out on a variety of pad constructions of the invention and two fiberglass commercial sound absorbent boards. Summarized here are the "Noise Reduction Coefficient" (NRC) values based on a standard industry test: "Test Method for Sound Absorption and Sound Absorption Coefficients by the Reverberation Room Method, ASTM C-423" ASTM, Philadelphia Pa., 1990. The specimens were suspended vertically in a free standing jig as described in ASTM C-423

TABLE 2

NOISE REDUCTION COEFFICIENTS, BONDED ACOUSTIC PADS

| | Composition | | | | |
|---|---|---|---|---|---|
| Example | Binder Fiber, % | Support Fiber, % | | Dens, lb./Ft$^3$ Type | NRC |
| 5 | 32 | 68 | Cellulose | 3 | 0.50 |
| 6 | 32 | 68 | Cellulose | 6 | 0.65 |
| 7 | 32 | 68 | Polyester | 3 | 0.50 |
| 8 | 32 | 68 | Blue Denim | 3 | 0.60 |
| 9 | 32 | 56 | Mineral Fiber | 6 | 0.60 |
| 10 | 32 | 68 | Cell/Mineral F, 50/50 | 3 | 0.50 |
| 11 | 32 | 68 | Cell/Mineral F, 50/50 | 6 | 0.65 |
| D | — | — | Fiberglass | 3 | 0.55 |
| E | — | — | Fiberglass | 6 | 0.60 |

The data show that bonded pads made by the instant invention, using a variety of support fibers, have NRC values in the same range as commercial fiberglass sound absorption panels. They have obvious processing advantages over fiberglass, e.g. greater flexibility and elimination of fiberglass handling problems.

Bonded pad directional strength of Example 5 and Comparative Example D were measured by the procedures described in Examples 1–4. However, it was found that there was adhesion failure with comparative example D, when measured in the X direction. Therefore, a conventional Grab Tensile Test ["Standard Test Method for Breaking Strength and Elongation ASTM D 5034-95" ASTM Philadelphia, Pa.] was used to determine strength in this direction. A similar measurement was made on Example 5 product, for comparative purposes and the results are shown below:

TABLE 3

BONDED PAD DIRECTIONAL STRENGTH

| Example | Composition | Test | Tensile | Relative St |
|---|---|---|---|---|
| D | Fiberglass Acoustic | X | 22.8** | 0.01 |
| | Insulation Board, 3#/cu ft | Z | 0.33 | |
| 5 | Acoustic Insulation, 3#/cu ft | X | 12.7*** | 0.80 |
| | 32%/68% Secondary Fiber | Z | 10.1 | |

**A conventional Grab Tensile Strength measurement, at a 2 inch gauge length.
***A Grab Tensile Strength measurement, comparable to that used to determine the Fiberglass X direction strength.

These results show that the predominant fiber orientation of the fibers in the Comparative Example is in the X-Y Plane. The Z/X relative strength of Example 5 is clearly superior to Example D.

We claim:

1. A process for forming a nonwoven web of fibrous material comprising:

(a) admixing about from 50% by weight of at least one support fiber for a period sufficient to disentangle and open the fibers and subsequently admixing with about from 5 to 35% by weight of at least one binder fiber to provide a substantially homogeneous mixture of fibers;

(b) conveying the mixture of fibers into a shaker chute positioned at an angle of about from 90 to 150 degrees with respect to horizontal;

(c) oscillating the fibers in the shaker chute for a period of about from 5 seconds to 1 minute to form a fiber web;

(d) depositing the resulting fiber web onto a substantially horizontal planar surface at a substantially uniform thickness of about from ⅛ to 6 inches;

(e) heating the fibers for a time and at a temperature sufficient to fuse at least some of the fibers; and (f) cooling the web to a substantially ambient temperature.

2. A process of claim 1 wherein the support fibers have a length of about from ⅛ to 4 inches.

3. A process of claim 1 wherein the support fibers in the mixture comprise about from 10 to 90% by weight natural fiber and about from 10 to 90% by weight synthetic fiber; and the binder fiber comprises about from 5 to 30% by weight of the mixture of support fibers and binder fibers.

4. The process of claim 1 wherein the support fibers comprise 100% by weight natural fibers.

5. A process of claim 1 wherein the support fibers comprise 100% by weight synthetic fibers.

6. A process of claim 1 wherein the support fibers comprise 100% by weight mineral fibers.

7. A process of claim 1 wherein the support fibers consist essentially of secondary cellulose.

8. A process of claim 1 further comprising removing impurities from the fibers during the admixing step.

9. A process of claim 8 wherein the impurities are removed from the fibers by mechanical means.

10. A process of claim 1 wherein the web is compressed by rollers after fusing and simultaneously with cooling.

11. A process of claim 4 wherein the natural fiber comprises secondary cellulose.

12. A process of claim 1 wherein the fibers are admixed by pneumatic and mechanical means.

13. A process of claim 1 further comprising introducing the mixture of fibers into a web forming chamber prior to the conveying step.

14. A process of claim 1 wherein the shaker chute is positioned at an angle of about from 95 to 135 degrees.

15. A process of claim 14 wherein the shaker chute is positioned at an angle of about 120 degrees.

16. A process for forming a nonwoven web of fibrous material comprising:

(a) admixing about from 65% to 95% by weight of at least one support fiber for a period sufficient to disentangle and open the fibers and subsequently admixing with 5 to 35% by weight of at least one binder fiber to provide a substantially homogeneous mixture of fibers;

(b) conveying the mixture of fibers into a shaker chute positioned at an angle of about from 90 to 150 degrees with respect to horizontal;

(c) oscillating the fibers in the shaker chute for a period of about from 5 seconds to 1 minute to form a fiber web;

(d) depositing the resulting fiber web onto a substantially horizontal planar surface at a substantially uniform thickness of about from ⅛ to 6 inches to form a web;

(e) heating the fibers for a time and at a temperature sufficient to fuse at least some of the fibers; and (f) cooling the web to a substantially ambient temperature.

* * * * *